US007451574B2

(12) United States Patent
Spek

(10) Patent No.: US 7,451,574 B2
(45) Date of Patent: Nov. 18, 2008

(54) CROWN MOLDING

(75) Inventor: Michael Timothy Spek, St. George, UT (US)

(73) Assignee: Spexco, LLC, Camarillo, CA (US)

( * ) Notice: Subject to any disclaimer, the term of this patent is extended or adjusted under 35 U.S.C. 154(b) by 0 days.

(21) Appl. No.: 11/074,231

(22) Filed: Mar. 7, 2005

(65) Prior Publication Data

US 2006/0196144 A1 Sep. 7, 2006

(51) Int. Cl.
*E04F 19/04* (2006.01)

(52) U.S. Cl. ..... 52/288.1; 52/718.01

(58) Field of Classification Search ..... 52/287.1, 52/288.1, 718.01, 718.04, 718.05, 716.6, 52/716.1, 718.06, 718.07, 717.05, 717.06, 52/220.5; 174/480, 491, 492, 503, 481; 403/265, 403/401; 135/909
See application file for complete search history.

(56) References Cited

U.S. PATENT DOCUMENTS

| | | | | | |
|---|---|---|---|---|---|
| 478,928 | A * | 7/1892 | Ellis | 52/288.1 |
| 1,825,010 | A * | 9/1931 | Murphy | 52/288.1 |
| 3,293,815 | A * | 12/1966 | Waldron | 52/288.1 |
| 3,821,869 | A * | 7/1974 | Morgan | 52/259 |
| 5,001,877 | A * | 3/1991 | Edwards | 52/288.1 |
| 5,359,817 | A * | 11/1994 | Fulton | 52/288.1 |
| 5,426,901 | A * | 6/1995 | Indracek | 52/288.1 |
| 5,651,224 | A * | 7/1997 | Brabant | 52/288.1 |
| 5,694,726 | A * | 12/1997 | Wu | 52/287.1 |
| 6,067,760 | A * | 5/2000 | Nowell | 52/204.57 |
| 6,122,872 | A * | 9/2000 | Sauter | 52/288.1 |
| 6,385,927 | B2 * | 5/2002 | Schiedegger et al. | 52/211 |
| 6,729,087 | B2 * | 5/2004 | Sauter | 52/290 |
| 7,040,065 | B2 * | 5/2006 | Pickup | 52/287.1 |
| 7,210,272 | B2 * | 5/2007 | Friday | 52/288.1 |
| 2003/0126825 | A1 * | 7/2003 | Dai | 52/717.01 |
| 2004/0168384 | A1 * | 9/2004 | Wesolowska | 52/287.1 |
| 2006/0096203 | A1 * | 5/2006 | Weinstein | 52/288.1 |
| 2006/0156679 | A1 * | 7/2006 | Pierret | 52/698 |

FOREIGN PATENT DOCUMENTS

| | | | |
|---|---|---|---|
| EP | 227342 | A2 * | 7/1987 |
| WO | WO 02/066764 | A2 * | 8/2002 |

OTHER PUBLICATIONS

WireTracks CM (http://webarchive.org/web/20041208204020/wiretracks.com/prod-cm.html). Dec. 4, 2007.*

* cited by examiner

*Primary Examiner*—Robert Canfield
*Assistant Examiner*—Christine T Cajilig
(74) *Attorney, Agent, or Firm*—Christie, Parker & Hale, LLP.

(57) ABSTRACT

A crown molding and system for its use where the crown molding is formed from a specially blended plastic as extrusions to have a roughened surface and consisting of an inverted "L" bracket and a facing crown mold member for each crown molding section. The inverted "L" bracket is formed as a right angle section having right angle legs and is to be attached to a wall at points along its lower leg, with the right angle bend fitting into the wall to ceiling junction, and with the top leg end having a coupling end for connecting to a mount of a facing crown molding member. Which coupling edges are preferably mirror image corrugations that fit over and lock together, and with the facing member ends flanges to contact the wall and ceiling surfaces.

21 Claims, 10 Drawing Sheets

CROWN MOLDING

BACKGROUND OF THE INVENTION

1. Field of the Invention

The present invention pertains to crown molding and to crown molding systems for use in new construction and remodeling.

2. Prior Art

Crown molding has historically and is currently manufactured in long wood sections for installation by a carpenter who miter cuts and fits the molding around a ceiling junction with the room walls. Such installation is labor intensive, requires a skilled carpenter and, accordingly, has been very expensive. The invention provides a crown molding that is preferably an extruded plastic inverted "L" bracket mounting members and a facing crown molding section or member that are quickly and easily installed without a need for a skilled or unskilled carpenter. Which installation involves installing an inverted "L" bracket mounting member, as by stapling or nailing it between the wall and ceiling, that includes a top corrugated end that receives a like corrugated end of the facing crown molding section fitted, spanning across the wall and ceiling junction. Which facing crown molding section may, but need not be, secured at a lower end portion; or flange to the wall by stapling or nailing, and, as needed, can also be attached at a top flange to the ceiling. After mounting, joint compound can be applied to junctions with the wall and ceiling and over any fasteners are floated with the joint compound, and a the intersection of the facing crown molding sections, melding the crown molding sections together and to the wall and ceiling surfaces. Whereafter the dried joint compound can be sanded and painted, or is left un-coated.

Further, unlike the miter cutting installation of the long wood crown molding sections around corners, the crown molding system of the invention employs ninety degree corner and forty five degree junction members that the straight sections are fitted to. This arrangement provides a complete crown molding system that is easy and economical to install by non-carpenters and will present a decorative appearance that is at least the quality of wood crown molding.

SUMMARY OF THE INVENTION

The invention is in a decorative crown molding and system for its use whose components are preferably formed from specially blended plastic to have a rough outer surface, by extrusion methods to fit together covering over, as a decorative feature, the junction of walls and ceiling around a room. The system includes straight members having opposing corrugated ends with tabs and spacers for fitting together in coupling arrangement. A first member is an inverted "L" bracket that is the mounting member and is secured at a lower end onto a wall, below the wall junction and with the ceiling, with fasteners, such as staples, at its lower end, and has a ridged upper outer end that can be bonded to a ceiling, as needed, as with a fastener therethrough to join it to the ceiling. The ridged upper end is for receiving, and coupling onto a like ridged end of a facing crown molding section that extends rearwardly from a top end of which facing crown molding section, may, but need not include an outer flange end that is planar to the ridged end. The facing crown molding section preferably has a decorative curved surface between straight flange upper and lower ends that receive joint compound along their junctions with a flat wall or ceiling surface. The facing crown molding section is preferably formed to have a rough outer surface, and when coupled together, provides a finished crown molding that may be painted or left unpainted.

Decorative crown molding straight sections ends are for coupling to ninety degree corner mounts and forty five degree junction mounting for providing a complete crown molding system for decorating any room. Which crown molding system can be installed by non-carpenters while still providing a quality decorative addition to the room.

It is a principal object of the present invention to provide a crown molding and system for its installation around a room wall and ceiling junction.

Another object of the present invention is to provide crown molding components formed from a specially blended plastic, by an extrusion methods, to accept a joint compound or epoxy filler that may be is sanded or left textured, for painting.

Another object of the present invention is to provide the facing crown molding arranged for mounting to an inverted "L" bracket that is for connection, at a base or bottom portion onto a wall surface, and fits into a corner junction with a ceiling, which wall mounting allows for some flexure of the inverted "L" brackets to allow for an overlapping, or male to female coupling, of the upper or ceiling engaging portions of the facing crown molding for receiving the inverted "L" bracket coupling end.

Still another object of the present invention is to provide a crown molding and system where an inverted "L" bracket component is conveniently anchored on their ends between a wall and ceiling, by conventional fasteners such as staples, nails or screws, or by an adhesive layer, with a facing crown molding component is arranged for attachment to the inverted "L" bracket component by fitting opposing corrugated members of the inverted "L" bracket top let and top of the facing crown molding component over one another, in coupling engagement, for joining together.

Still another object of the present invention is to provide a crown molding system that includes straight members and, ninety and forty five degree corner members that receive ends of the straight members fitted thereto receive joint compound applied thereover and along the joints, that can be sanded and/or left textured, to receive paint applied thereto, providing a versatile system for covering the walls and ceiling junctions.

Still another object of the present invention is to provide a crown molding system that is simple to install by even an unskilled person, includes pre-fabricated corners and angle members allowing the system to be installed with no compound miter cuts and will provide a room with crown molding of the same or better appearance to one constructed by a skilled carpenter.

BRIEF DESCRIPTION OF THE DRAWINGS

These and other objects and features of the present invention will become more apparent from the following description in which the invention is described in detail in conjunction with the accompanying drawings.

DETAILED DESCRIPTION

The invention, as is hereinafter described, relates to crown mold and crown molding systems that have heretofore been installed by skilled carpenters. Whereas, the present invention provides extruded plastic components that are preferably formed from a plastic composite material, with an outer crown molding surface to allow the finished crown molding to accept a layer of joint compound, providing a texture thereto, that can be painted or left unpainted. The crown molding of the invention can be easily installed by a non-carpenter having little or minimum experience, who installs the crown molding system so as to provide a finished crown molding that is comparable if not better looking than wood crown moldings as have been carpenter installed.

Figure 1:
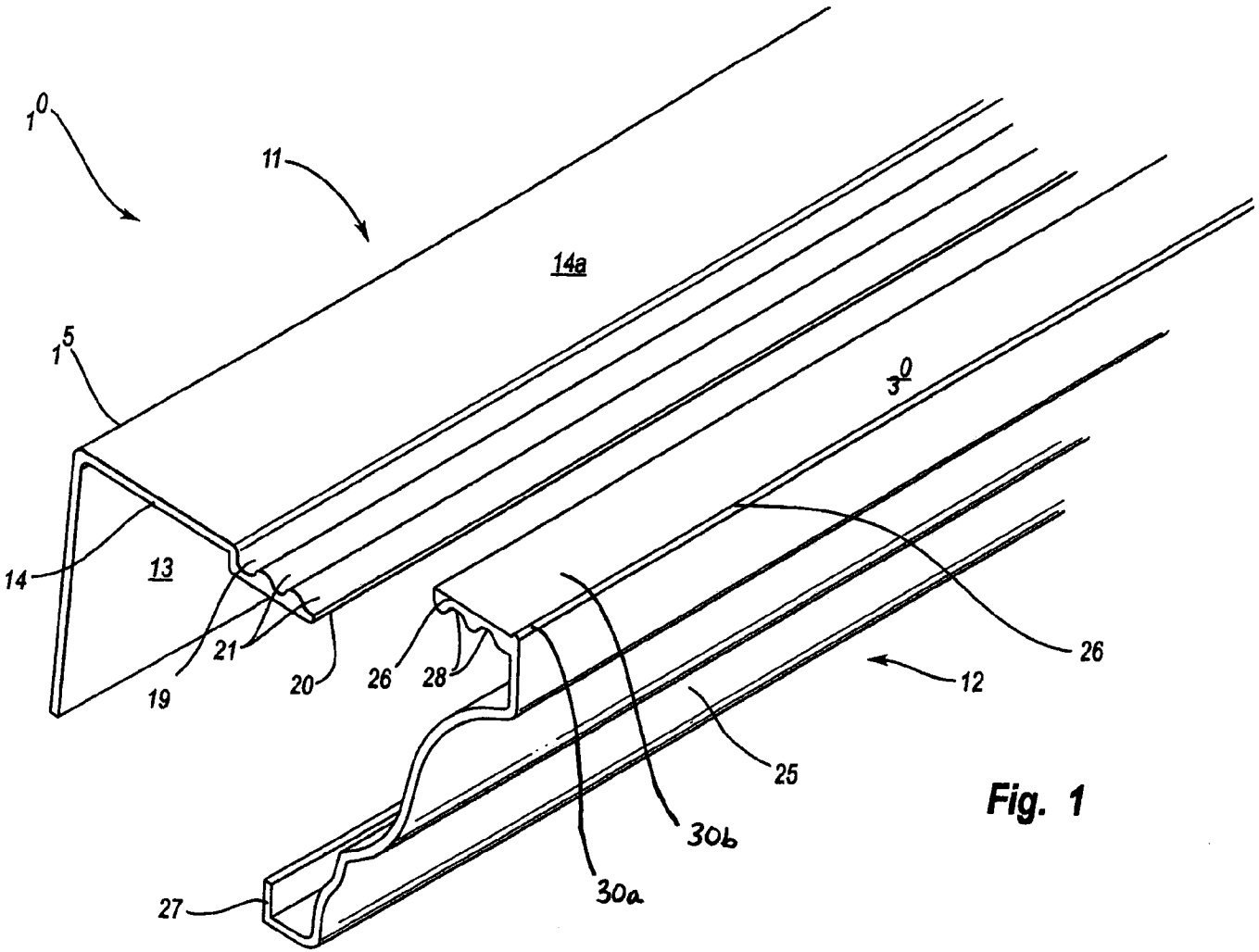
FIG. 1 is a side elevation perspective view of aligned inverted "L" bracket and facing crown molding components of a section of crown molding of the invention positioned to be fitted together.
Figure 2:
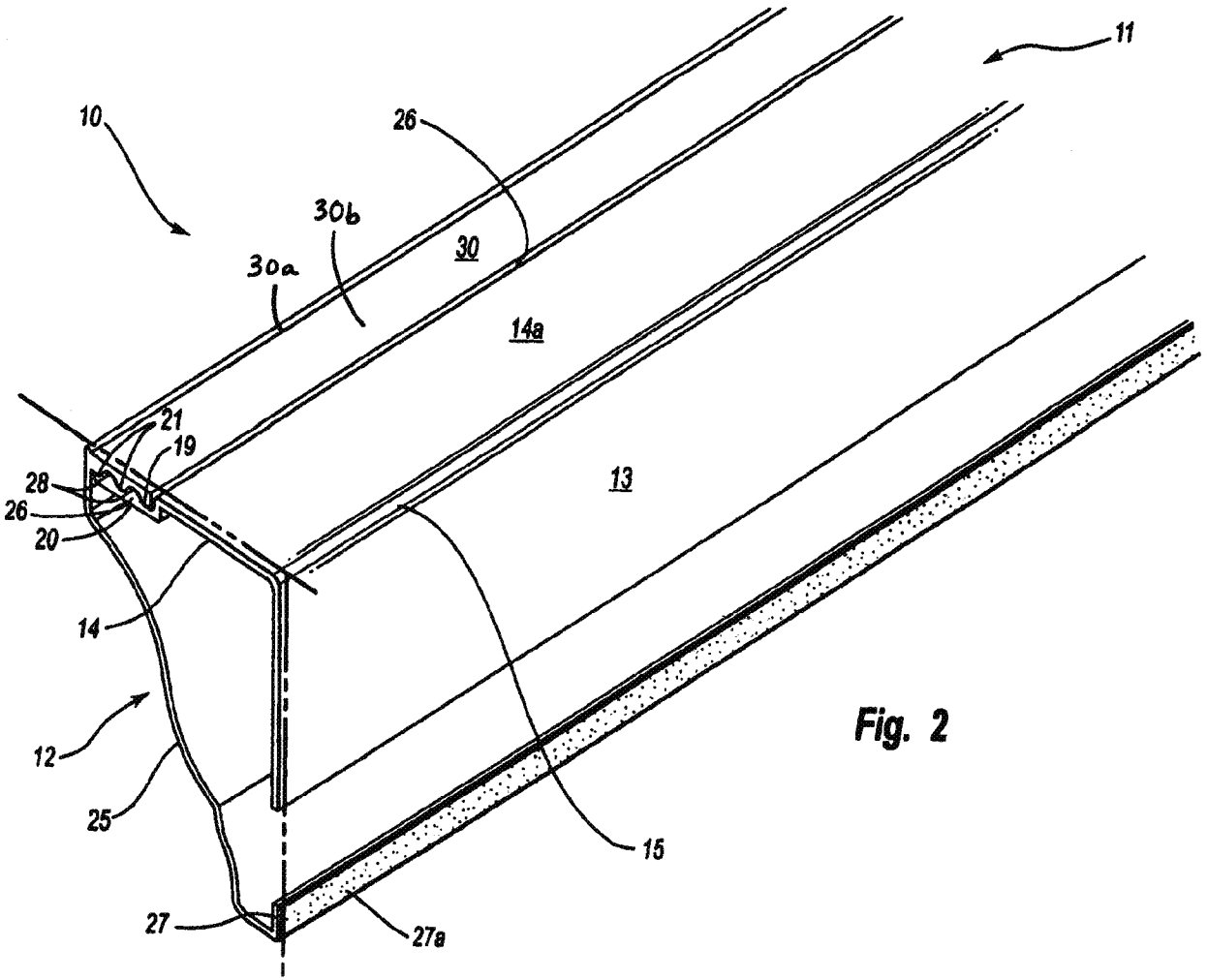
FIG. 2 shows a rear elevation perspective view of the inverted "L" bracket and facing crown molding components of FIG. 1 that have been fitted together into a section of crown molding.
Figure 3B:
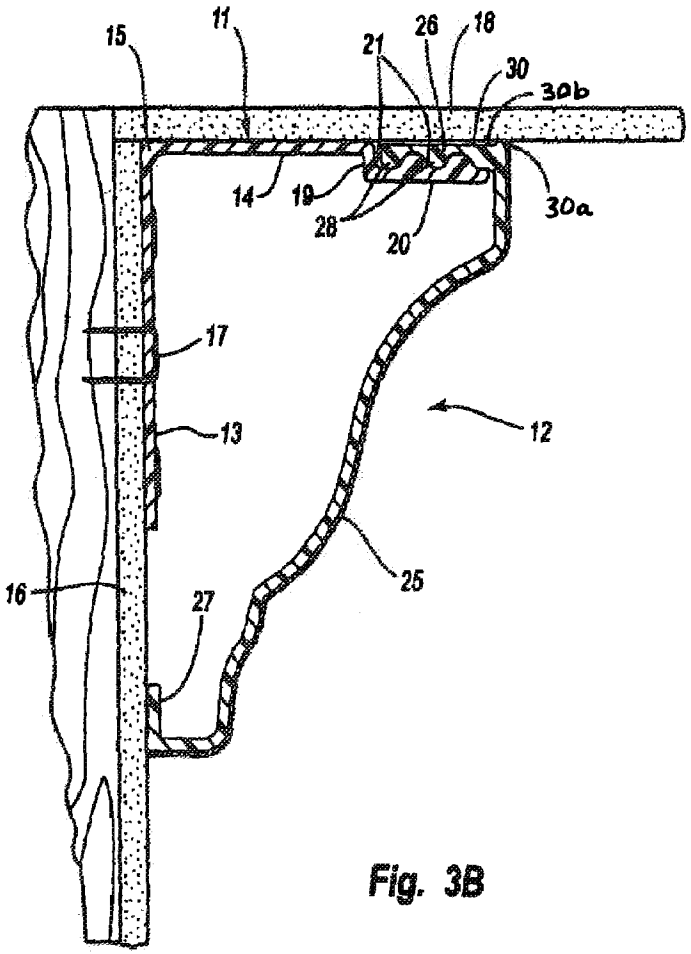
FIG. 3B is a view like that of FIG. 3A additionally showing a layer of joint compound as has been applied to the junction of the crown molding of the invention with the wall and ceiling.
Figure 3A:
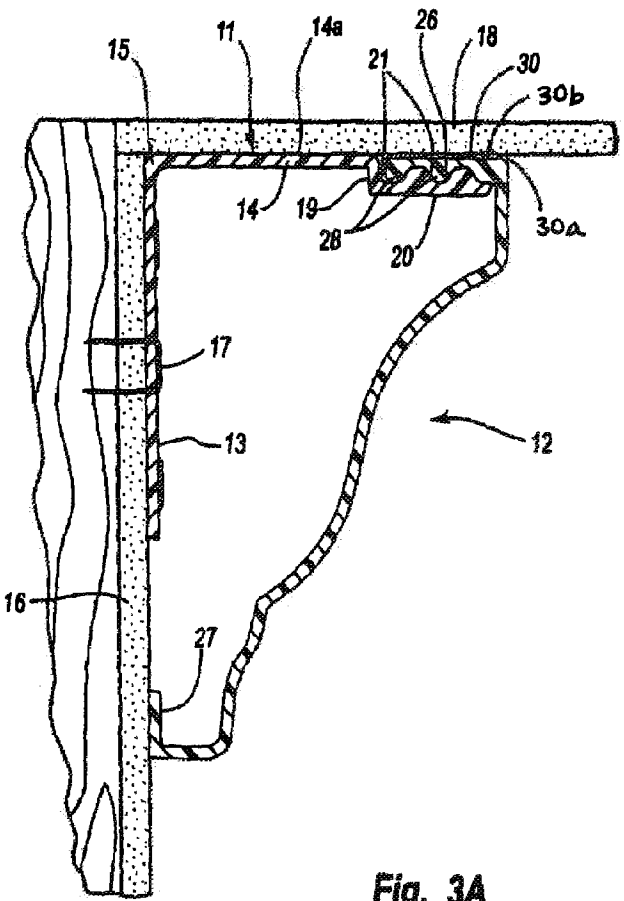
FIG. 3A shows a side elevation sectional view of the inverted "L" bracket and facing crown molding components joined together across a ceiling and wall junction, and showing an inverted "L" bracket wall leg stapled onto a wall.

A first embodiment of the crown molding 10 of the invention is shown in a frontal perspective view taken from the left side of FIG. 1, that shows an inverted "L" bracket 11, hereinafter referred to as "L" bracket 11, that is aligned for coupling with a facing crown molding section or member 12, hereinafter referred to as, facing member 12, forming a straight section of crown molding. The "L" bracket, as shown, includes flat rectangular first or side leg 13 and a top leg 14, having an outer face 14*a*, respectively, that join along junction 15, forming a right angle. The first or side leg 13, as shown in FIGS. 3A and 3B, is for mounting onto a sheet rocked wall 16, as by staples 17 with flat top leg 14 surface 14*a* for positioning against a ceiling 18 whereby the junction 15 fits into the right angle junction of the wall 16 and ceiling 18. The flat top leg 14 top surface 14*a* is shown as stepped downwardly at a right angle, shown at 19, into a corrugated coupling end section 20 having a flat under surface that is essentially parallel to the top leg 14. Which corrugated coupling end section 20 includes individual lateral corrugations 21 that are parallel and equidistant from one another and extend the length of corrugated coupling end section 20. The corrugations 21 are to receive and fit to spaced corrugations 28 that are formed back from a forward edge in an undersurface of a top mounting end 26 of the facing member 12, coupling the facing member 12 to the "L" bracket 11, to form a length of crown molding 10, as set out below.

The facing member 12 is for connection to the "L" bracket, to span across the wall and ceiling junction as a decorative wall trim. Accordingly, the facing member includes an attractively curved face 25 between a flat top mounting end 26 and a flat upturned foot 27. The face 25 has a substantially vertical front-facing surface near the top mounting end 26, above the curved portion of the face 25. As shown in FIGS. 1 through 3B, the face bisects the undersurface of the flat top mounting end 26, that, on a rear end, includes lateral spaced parallel corrugations 28, and on a forward end includes a ceiling top surface 30. The ceiling top surface 30 comprises a flat inner portion 30*b*, and a ridge portion 30*a* at the forward edge of the ceiling top surface 30, where the ceiling top surface 30 meets the curved face 25 at a corner. The corrugations 28 are the mirror image of the corrugations 21, such that, when fitted over one another, the corrugations lock together, as shown in FIGS. 1, 3A, and 3B. Shown in FIG. 1, the "L" bracket 11 and facing crown molding member 12 are aligned to fit together, with, in FIG. 2, they have been fitted together, forming a straight section of crown molding 10, with the ceiling top surface 30 and flat foot end 27 of the facing member 12 are in contact with the ceiling and wall 18 and 16, respectively, of FIGS. 3A and 3B. As shown in FIGS. 3A and 3B, the ceiling top surface 30 contacts the ceiling 18 along the ridge portion 30*a* of the ceiling top surface 30, with the inner flat portion 30*b* of the ceiling top surface 30 spaced away from the ceiling. To install the facing member 12, a layer of joint compound is applied to the wall surface whereto the facing member top surface 30 and foot 27 surface are to be positioned, and the facing member is pushed into that layer. Alternatively, where it is desired to fix the facing member to a dry surface, an adhesive layer can be applied to the top surface 30 and the foot surface 27 prior, shown as layer 27*a*, to its application onto the wall surface.

Shown best in FIGS. 3A and 3B, with the "L" bracket 11 side leg 13 is mounted onto the wall 16, by staples 17, with the flat top leg 14 contacting the ceiling 18, and which top leg 14 can be flexed downwardly a sufficient distance to allow the facing member 12 flat top mounting end 26 to be slid between the ceiling and the "L" bracket corrugated coupling end section 20. In which passage, the corrugations 28 of the flat top mounting end 26 travel over the corrugations 21 of the "L" bracket corrugated coupling end section 20. The corrugations thereby fully mesh, as shown in FIGS. 3A and 3B, locking together, with the "L" bracket flat top leg 14 then flexing back towards the ceiling 18. So arranged, to complete the facing member 12 mounting, joint compound, as shown in FIG. 3B, is applied between the wall and ceiling at the top and foot ends of the facing member.

Figure 4:
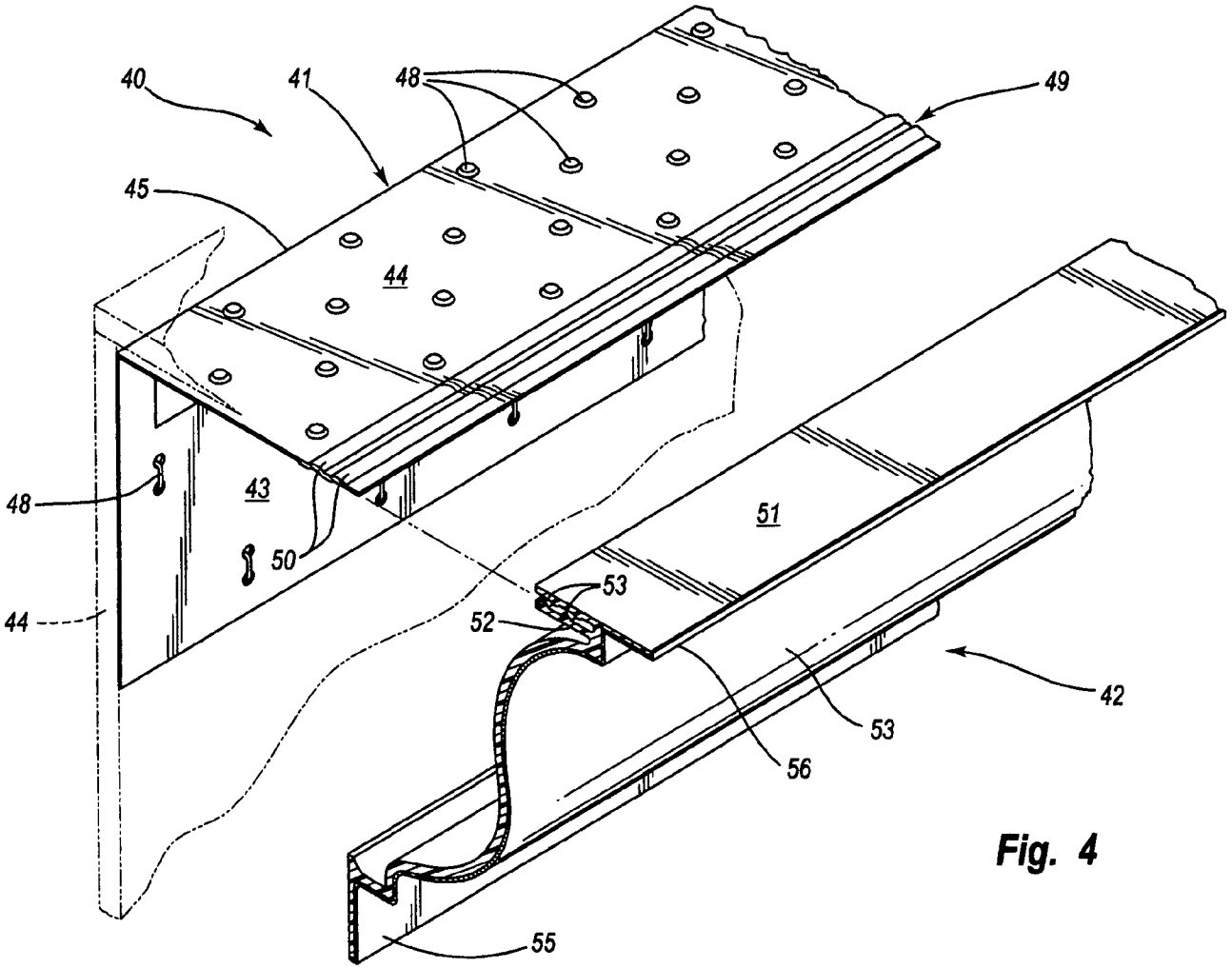
FIG. 4 shows an exploded view of an additional embodiment of the crown molding of the invention that includes male and female coupling ends of top legs of the inverted "L" bracket and facing crown molding mounting, respectively, a female coupling on the top end facing crown molding section aligned with a male member that is formed on a top leg end of the inverted "L" bracket, providing a "snap-in" coupling of the facing crown molding member to the inverted "L" bracket that is shown as having been connected by staples to the wall, and includes a plurality of spaced dimples formed in the top leg surface that is in contact with a ceiling surface, with each dimple functioning as a stand-off to allow the crown molding member female member upper surface to pass along the ceiling surface.
Figure 5B:
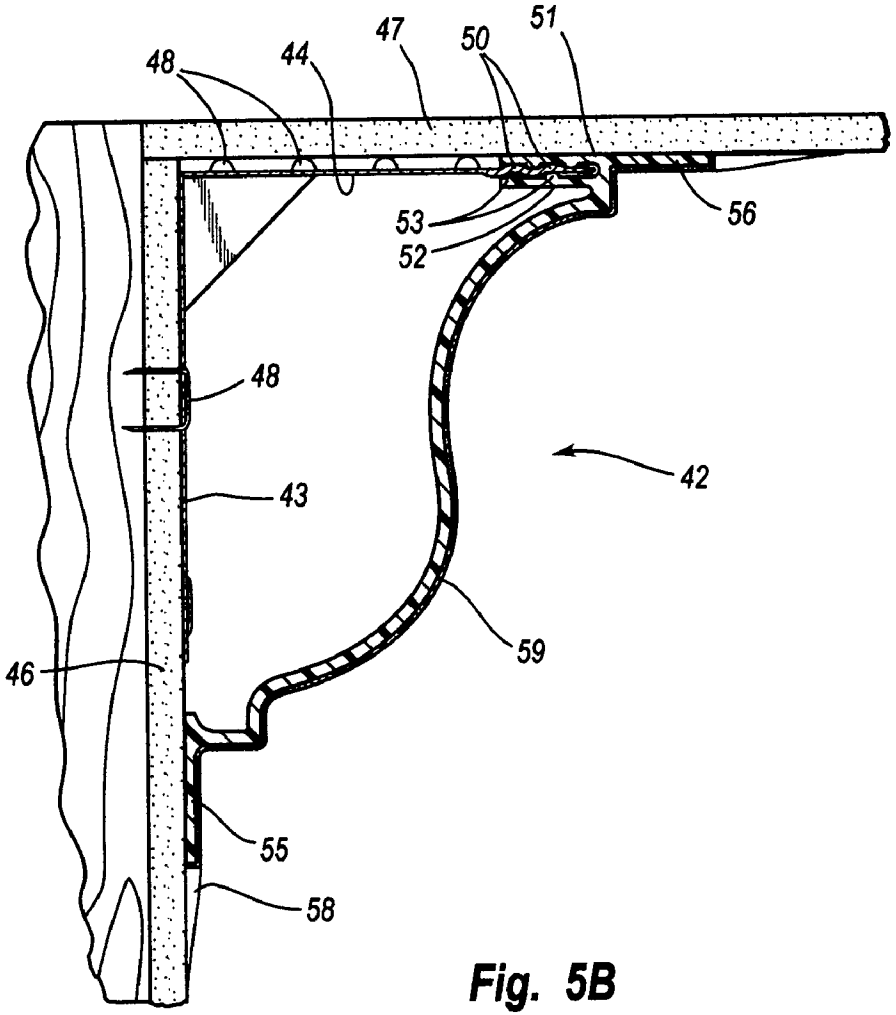
FIG. 5B is a view like that of FIG. 5A additionally showing a layer of joint compound as having been applied to the junction of the crown molding of the invention ends with the wall and ceiling.
Figure 5A:
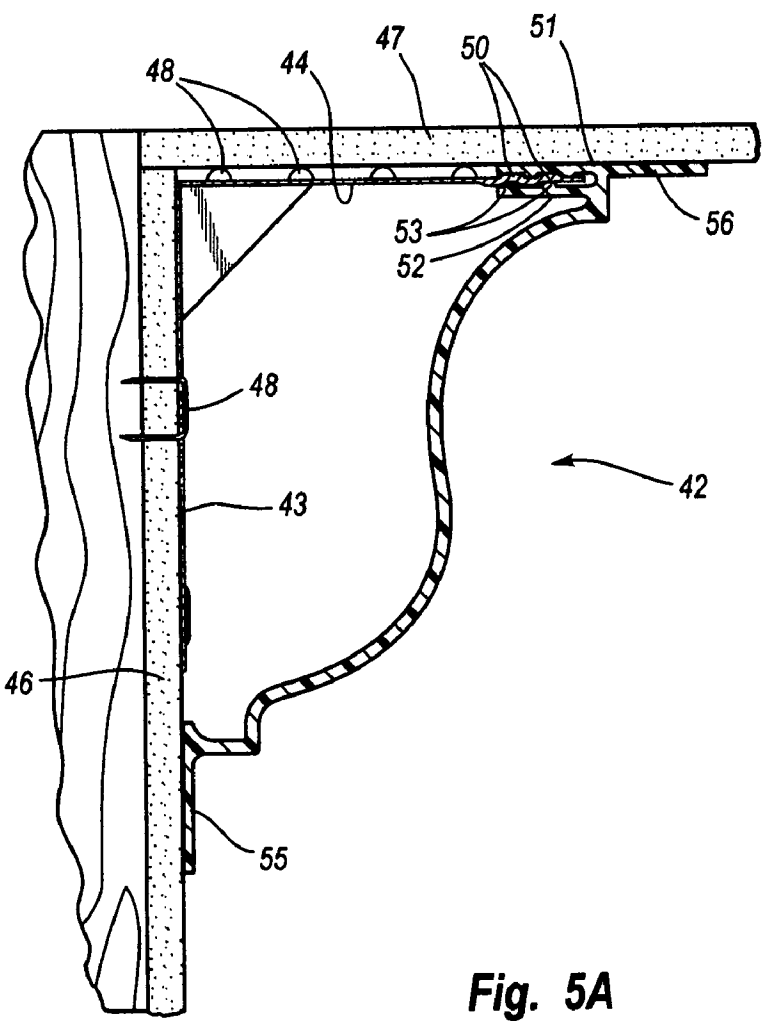
FIG. 5A shows a side elevation sectional view of the coupled inverted "L" bracket and facing crown molding of FIG. 4 shown mounted across the junction of a wall and ceiling.

FIG. 4 and FIGS. 5A and 5B show another embodiment of a crown molding 40 that also includes an inverted "L" bracket 41, hereinafter referred to as "L" bracket 41, and facing crown molding section or member 42, hereinafter referred to as, facing member 42. Like the "L" bracket 11, the "L" bracket 42 has side and top legs 43 and 44, respectively, that are joined at a right angle along junction 45. The crown molding 40 embodiment, like the crown molding 10 embodiment, is for fitting into the corner or junction between a room wall 46 and ceiling 47, as shown in FIGS. 5A and 5B, with staples 48, or like fasteners passed through the "L" bracket side leg 43, for mounting the "L" bracket to the wall. Distinct from the "L" bracket 11 that fits against the ceiling 18, the "L" bracket 41 top leg 44 includes spaced stand offs 48, shown as dimples, whose tops contact the ceiling surface, providing a space between the top leg and ceiling. Which space is to accommodate the thickness of a female coupling end 53 of the facing member 42 that is fitted onto a male member end 49, for joining the "L" bracket and facing member together forming a section of crown molding 40, as set out below.

To provide for connecting the facing member 42 onto the "L" bracket 41, forming the section of crown molding 40, the "L" bracket top leg 44 is provided with the outer male connector 49 end that is corrugated at 50 across both its upper and lower surfaces, and the facing member 41, below a top section 51, includes a female coupler 52, that is shown as a narrow U, and has corrugations 53 formed in the opposing U surfaces that are mirror images of the corrugations in the opposite surfaces of the outer male connector 49. So arranged, as the female coupler 52 is slid onto the outer male connector 49, the male connector lower surface of the U flexes, allowing the male connector 49 to travel therein, with the contacting corrugations to ratchet over one another until the male member is fully installed in the female member, completing the coupling, as shown in FIG. 5A. Thereafter, a crown molding 40 facing member 42 flat foot end 55 and flat ceiling flange contacting strip 56 can be attached to the wall and ceiling respectively with fasteners, not shown, such as staples, nails, screws, or the like, that are driven through the foot end 55 and contacting strip 56 and into the wall 46 and ceiling 47, respectively. Which completed installation is shown in FIG. 5A. Thereafter, as shown in FIG. 5B, joint compound 58 can be applied to the flat foot end 55 and ceiling flange contacting strip 56, to also cover over connectors as are used to join the foot end 55 and ceiling contacting strip 56 to the wall and ceiling, respectively, and the joint compound can be applied or floated over an outer surface 59 of the facing member 42, as needed. Which coated facing member can then be painted, or a like decorative surface applied thereto, as desired.

Figure 6B:
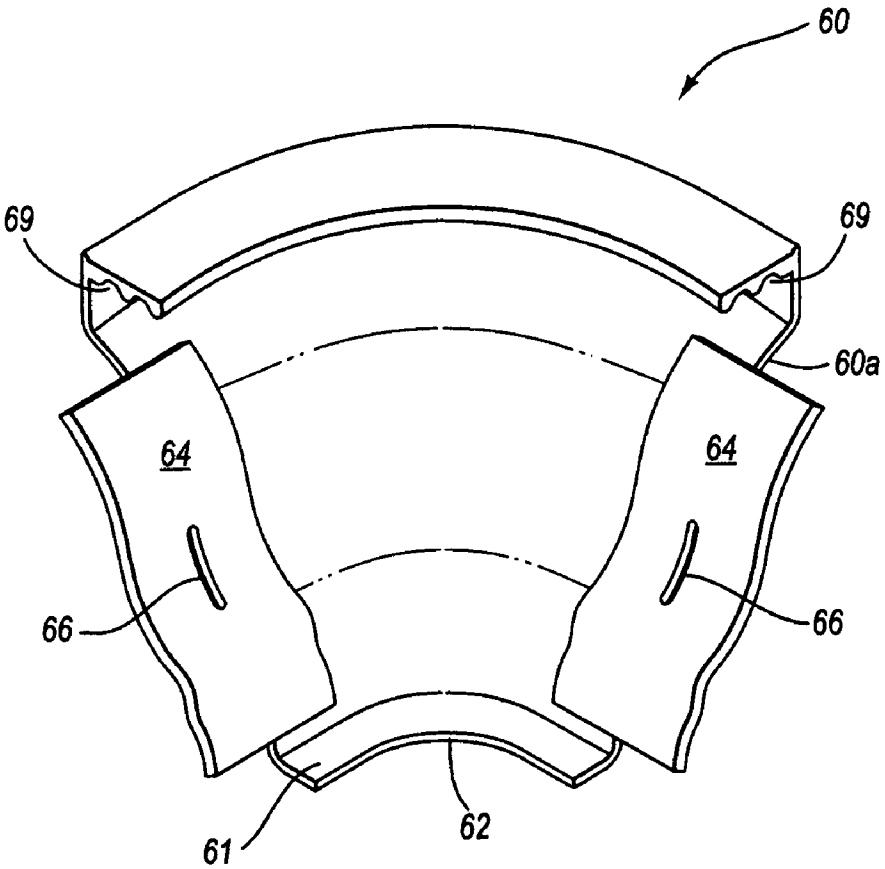
FIG. 6B shows a rear elevation view of the corner section of FIG. 6A.
Figure 6A:
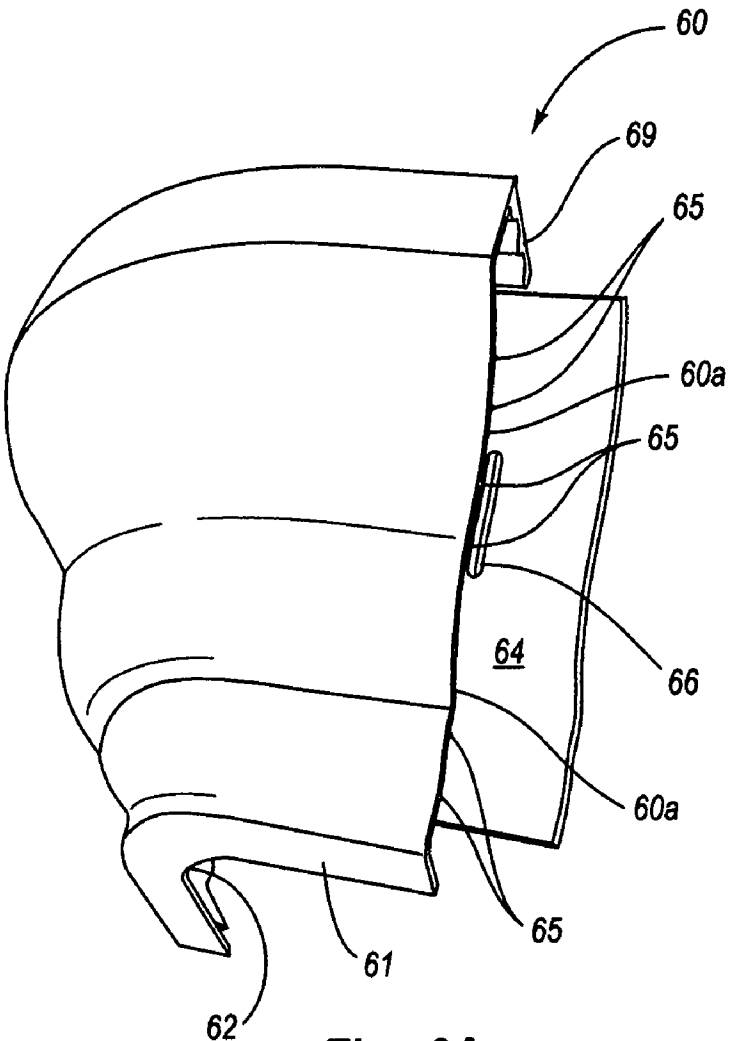
FIG. 6A shows a side elevation view taken from the front and side of an outside corner section of the molding system of the invention.
Figure 11:
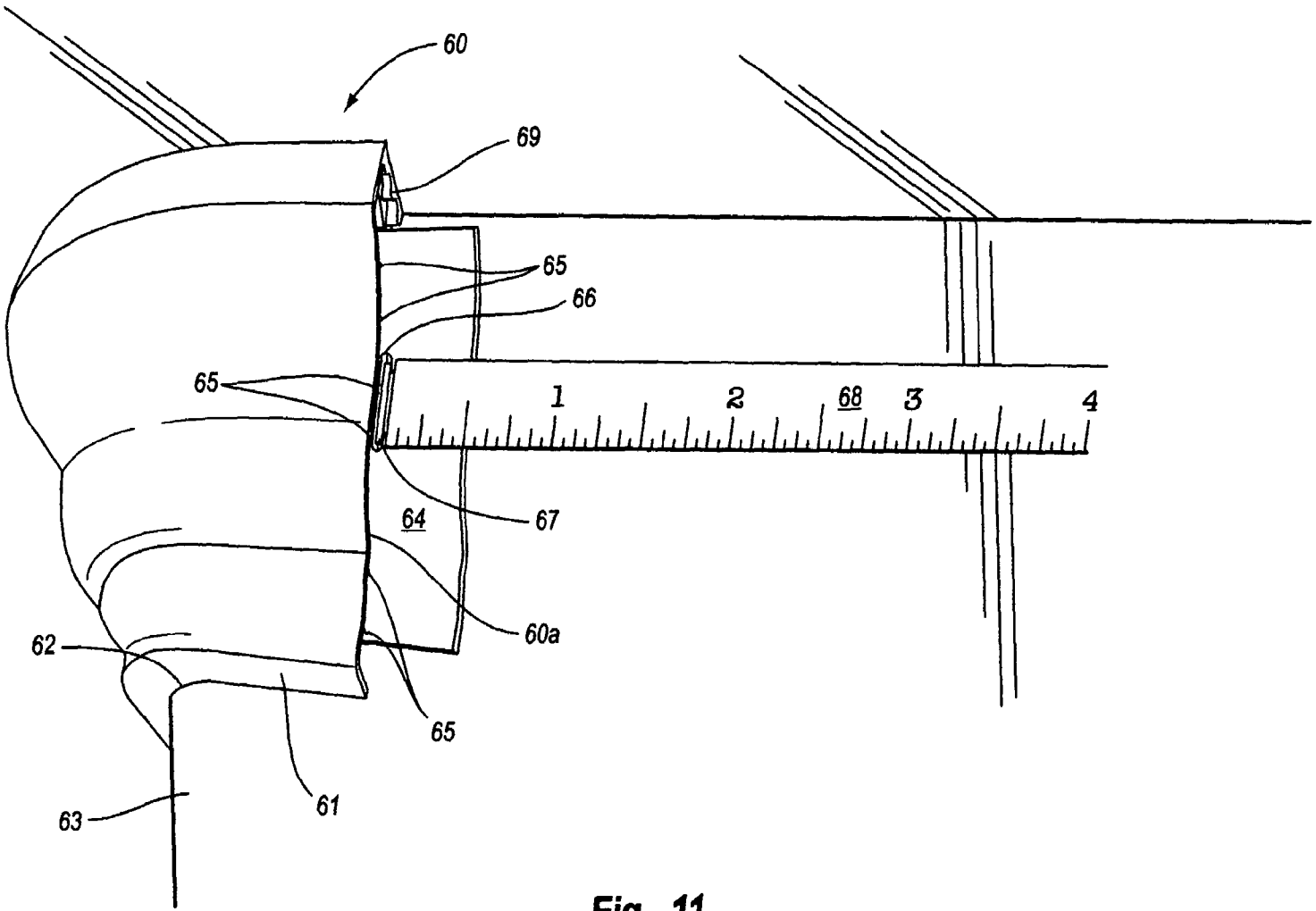
FIG. 11 shows a side elevation view of a room corner whereto the outside corner of FIG. 6A is installed, and showing a tape measure end installed in a slot formed in a junction of a side and tab of the outside corner, and showing the tape as drawn out for measuring a distance from the corner member edge whereto a straight section of the crown molding system of the invention is to be installed.
Figure 12:
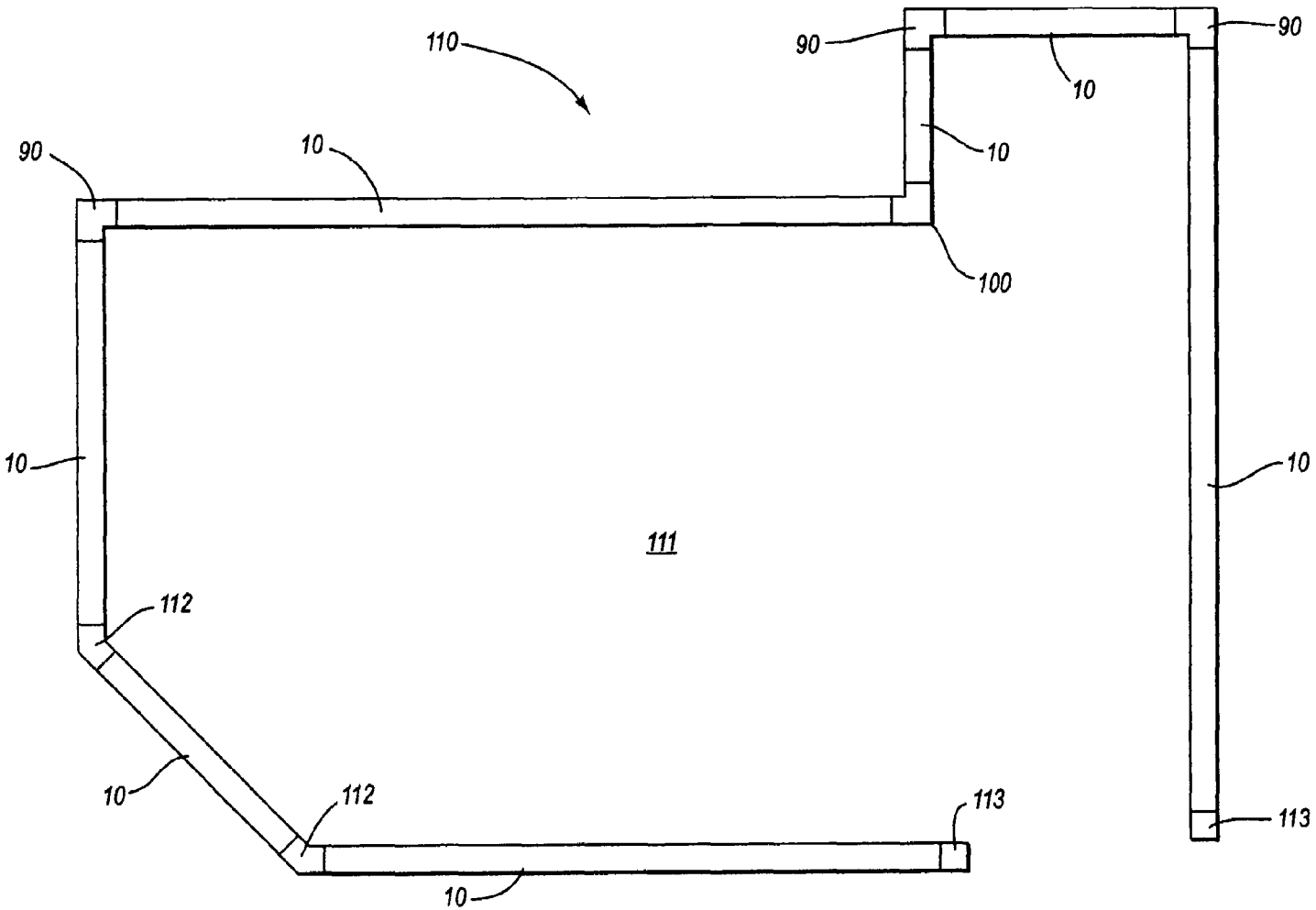
FIG. 12 shows an example of a floor plan the crown molding system of the invention as has been employed to cover the floor to wall junction around an entire room.

FIGS. 6A, 6B, 7, 8, 9 and 10 show examples of embodiments of corner components of the crown molding system of the invention that enable the system to be installed with no compound miter cuts. FIGS. 6A and 6B show front and rear views, respectively, of an outside corner 60 having a rounded section 62 at the apex of the right angle legs of the corner 60 base 61, which rounded section 62 is for fitting, as shown in FIG. 11, around a wall rounded corner 63. The corner 60 has, between ends 60*a*, the same facing contours as the straight facing member 12 or 42 to connect to an end thereof. In which coupling, the facing member end is slide over a tab 64 that is shown attached to the corner 60 rear surfaces, extending from the corner ends 60*a*, as shown in front and rear views in FIGS. 6A and 6B, respectively, and in FIG. 11. In forming a crown molding system for a room, as shown in FIG. 12, the individual tabs 64 brace the facing members 12 or 42 ends that have been fitted against corner ends 60*a* against inward flexure. In fitting a facing member 12 or 42 end over a tab 64, that end will butt into spacers 65 formed in the corner ends, above tabs 64. Which spacers 65 are shown in FIGS. 6A and 11 as half beads and are for providing separation along the junction between a facing member end and side of corner 60 to receiving a layer of joint compound troweled therein in forming the crown molding system of FIG. 12. In forming which crown molding system of FIG. 12, it is often necessary to cut a straight facing member to a measured length to fit between corners. FIG. 11 illustrates such measuring where, with the corner 60 secured to a room outside corner, a hook end 67 of a tape of a standard tape measure is fitted into a slot 66 formed in the tab 64, alongside of the corner end 60*a*, and the tape is pulled out from a tape body, not shown, to measure the distance. For connecting the facing member 12 or 42 to the corner 60, the corner top end is turned in and includes lateral corrugations 69 that complement and will couple to corrugations 21 of an "L" bracket corrugated end section 20.

Figure 7:
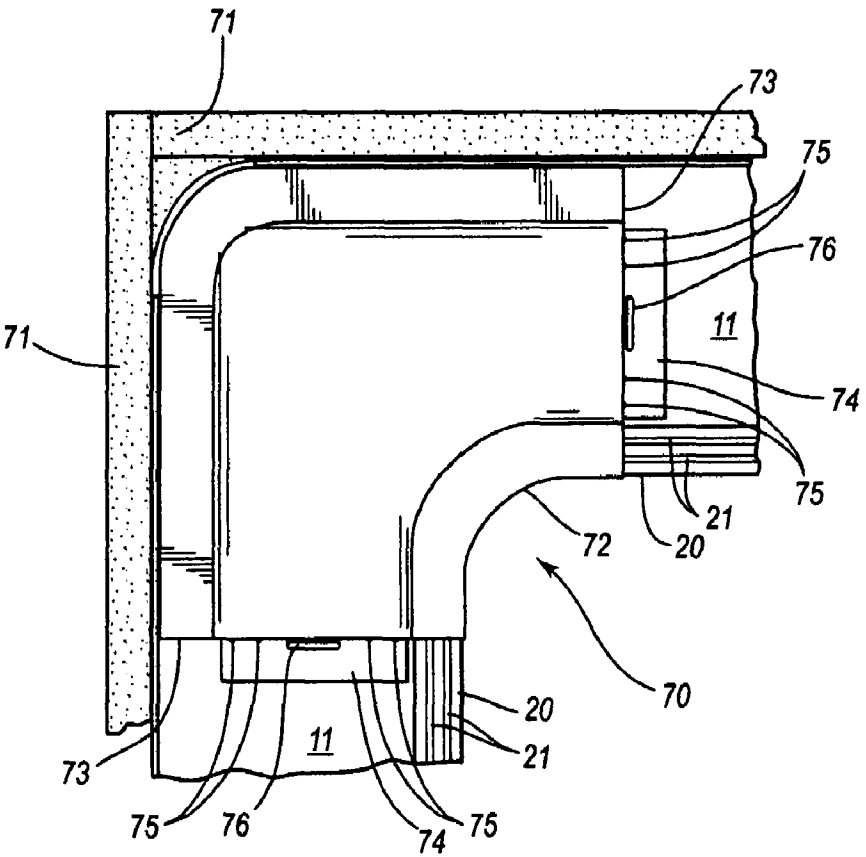
FIG. 7 shows a top plan view of an inside corner section of the crown molding system of the invention.

FIG. 7 shows an inside corner 70 fitted into a wall corner formed by sections of sheet rock 71, and shows the corner 72 as rounded with ends of "L" brackets 11, as shown in FIGS. 1, 2, 3A and 3B, mounted to the sheet rock walls 71 where corrugated end sections 20 of the "L" brackets 11 extend just under ends 73 of the corner 70 and with corner 70 corrugations, that are like the corrugations 28 of the facing member 12, and fit onto the "L" brackets 11 corrugations 21. As shown, like the outside corner 60, the inside corner 70 includes tabs 74 that each extend outwardly from the corner 70 ends 73, have spacers 75, and includes slots 76 formed through the tabs at their junction with the corner ends 73 that receive hook ends of a tape measure fitted therein, like that shown in FIG. 11, for facilitating measuring a distance from the corner 70.

Figure 8:
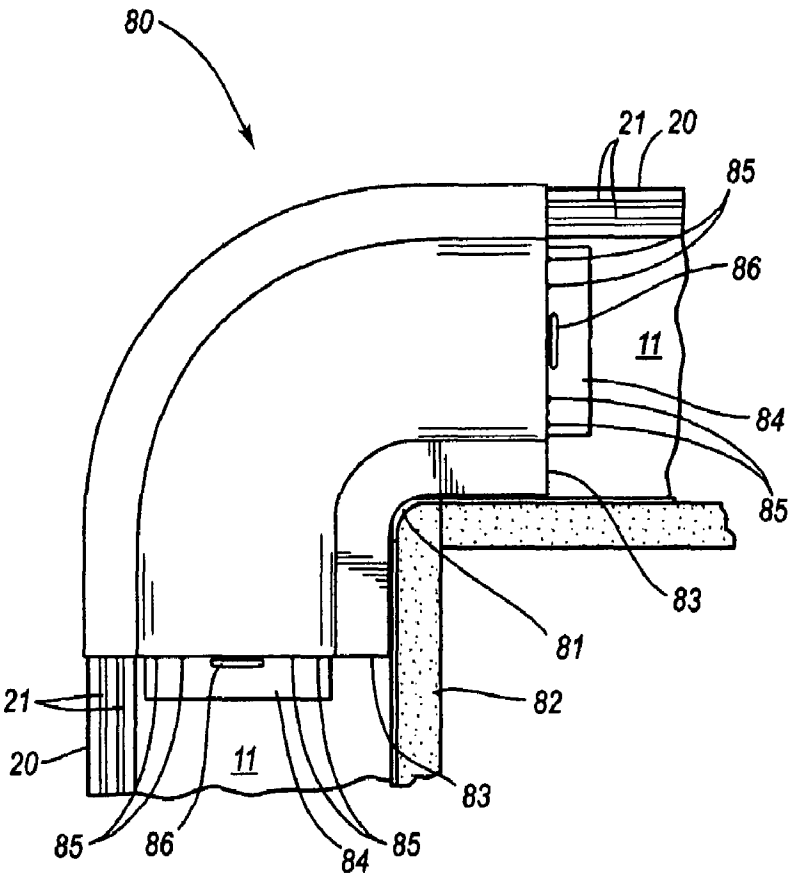
FIG. 8 shows a top plan view of an outside corner section of the crown molding system of the invention.

FIG. 8 is a view like that of FIG. 7 only showing an outside corner 80 having an inner corner 81 that is slightly rounded and is fitted over a slightly rounded right angle corner formed by sections of sheet rock 81. Like the corners 60 and 70, the outside corner 80 includes tabs 84 that each extend outwardly from the corner 80 ends 83, have spacers 85, and include slots 86 formed through the tabs at their junction with the corner ends 83. Which slots 86 are end to receive a hook end of a tape measure fitted therein, like that shown in FIG. 11, for facilitating measuring a distance from the corner 80.

Figure 10:
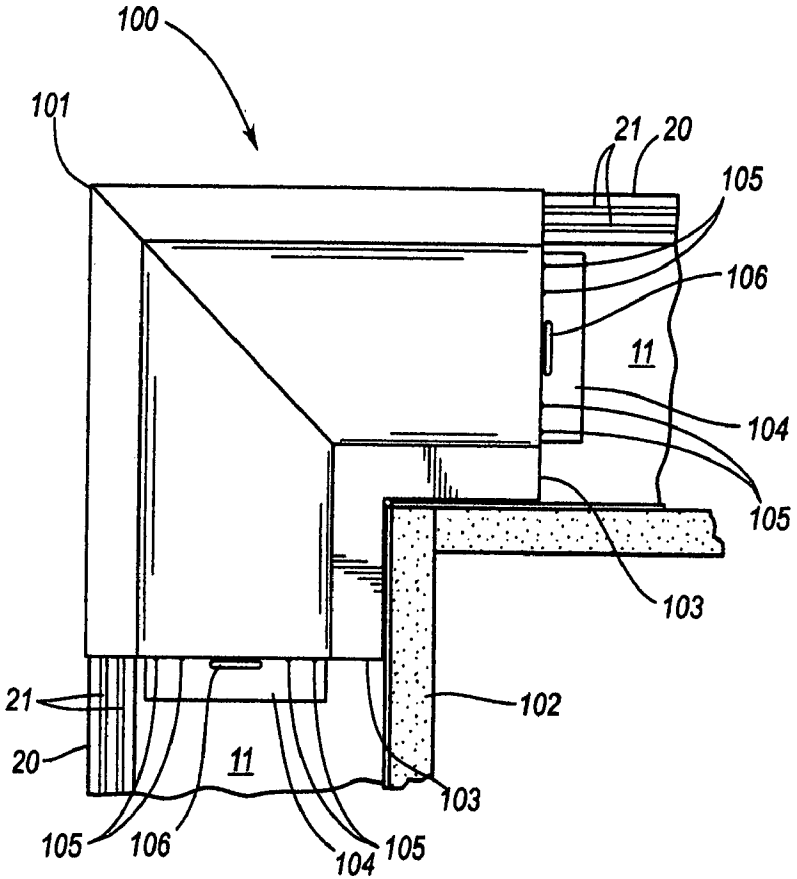
FIG. 10 shows still another embodiment of another embodiment of an outside corner of the crown molding system of the invention.
Figure 9:
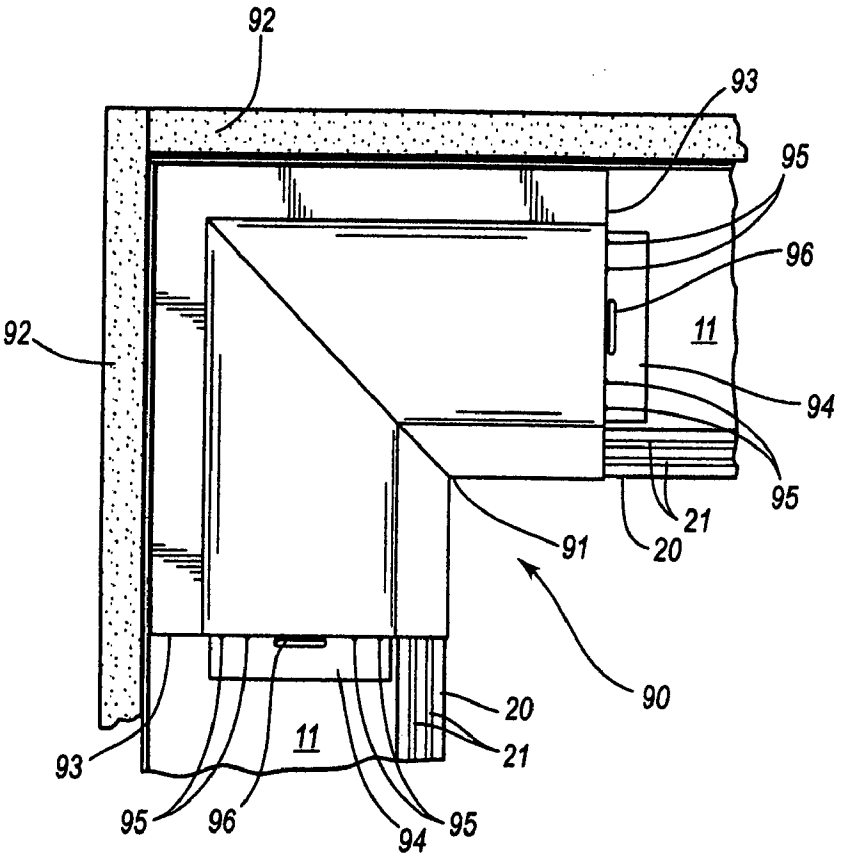
FIG. 9 shows atop plan view of still another embodiment of an inside corner of the crown molding system of the invention.

FIGS. 9 and 10 are like FIGS. 7 and 8 in that they show are inside and outside corners 90 and 100, respectively. Which inside and outside corners 90 and 100, respectively, have a right angle exterior corner 91 and a right angle exposed corner 101, respectively, with the corner 90 for fitting snugly against a wall outside corner formed by sheet rock panels 92, and with the corner for fitting snugly against a wall inside corner formed by sheet rock panels 102. Like the corners 70 and 80 of FIGS. 7 and 8, The corners 90 and 100 also include tabs 94 and 104, respectively, that extend outwardly from corner ends 93 and 103, respectively. Which corner ends 93 and 103 also include spacers 95 and 105, respectively, that are half spherical segments, and each tab includes a slot 96 and 106, respectively, adjacent to the corner end 93 and 103, respectively, for receiving a tape measure end to facilitate measuring a distance from the corner end.

FIG. 12 shows a top plan view of a schematic of a room 111 whose ceiling corners have been fitted with a crown molding system 110 of the invention. Shown therein the junction of the wall and ceiling have been fitted with the straight and corner components, shown in FIGS. 1 through 3B, and 6 through 9, and further include forty five degree angle members 112 that are like the inside and outside corners 90 and 100, respectively, as shown in FIGS. 9 and 10 and as discussed above, except that the member legs form a forty five degree angle rather than a corner ninety degree angle, and the system ends can include caps, shown as items 113, that are arranged like the corners, and are fitted to the molding system ends at a doorway. FIG. 12 illustrates a use of crown molding 10 straight sections that are fitted end to end to the respective crown molding system components, with the ends of the sections fitting over tabs of the corner members, butting together against the spacers, providing, after application of a joint compound, a crown molding having a continuous appearance. Like the above described crown molding 10 and 40, the respective corner members 60, 70, 80, 90 and 100 are each formed from an "L" bracket and facing member that are joined together, as described above for the crown moldings 10 and 40. Which connected sections and members include a tab, as shown and described above, that is secured on a rear surface of the facing member, preferably across a mid point of the curved section, and will extend across the joint and behind the end of and adjacent facing member, supporting the butted joint. Which joint then preferably receives a layer of joint compound floated into the joint to provide a smooth appearance. Where the crown mold 10 straight sections are shown used in FIG. 12, it should be understood that the crown molding 40 straight sections could be substituted therefore, within the scope of this invention. Further, while an "O Gee style" of crown molding is shown in the drawings it should be understood that the invention can be formed to have any current and even future style of curve as the face of the facing crown molding member, within the scope of this disclosure.

Hereinabove has been set out a description of a preferred embodiment of the crown molding and system for its use. It should however, be understood that the present invention can be varied within the scope of this disclosure without departing from the subject matter coming within the scope of the following claims, and a reasonable equivalency thereof, which claims I regard as my invention.

I claim:

1. A crown molding comprising:

an "L" bracket section formed by upper and lower legs , said lower leg for attachment to a room wall with the upper leg proximate to a room ceiling; and a facing crown molding member for fitting to said "L" bracket section, the facing crown molding member having a uniform cross section;

wherein an undersurface of an upper flange of said facing crown molding member includes first corrugations for meshing engagement with second corrugations in a top surface of said "L" bracket section upper leg, the "L" bracket section upper leg being deflectable away from the room ceiling to receive the top end of the facing crown molding member with the first and second corrugations in meshing engagement, such that the "L" bracket section upper leg flexes back toward the room ceiling with the first and second corrugations in meshing engagement, wherein the facing crown molding member comprises a substantially vertical front-facing surface at its upper end below the upper flange, and wherein the upper flange of the facing crown molding member has a substantially flat top surface and a ridge portion that extends past the top surface to contact the ceiling, the ridge portion being flush with the substantially vertical front-facing surface.

2. The crown molding as recited in claim 1, wherein the "L" bracket section upper and lower legs comprise straight rectangular sections that meet at a substantially right angle junction.

3. The crown molding as recited in claim 1, wherein the "L" bracket section and facing crown molding member are formed from a plastic material.

4. The crown molding as recited in claim 1, wherein a plurality of facing crown molding members are fitted together end to end, in butting engagement; and ends of said facing crown molding members are joined in butting engagement to ends of inside and outside corners that are arranged for mounting on each side of a room corner.

5. The crown molding as recited in claim 4, wherein the facing crown molding members and the inside and outside corners have a roughened outer surface.

6. The crown molding as recited in claim 4, wherein the inside and outside corners include tabs extending outwardly from said room corner and include third corrugations in a top of said inside and outside corners for engaging said second corrugations of said "L" bracket section upper leg.

7. The crown molding as recited in claim 6, wherein the third corrugations are formed on an undersurface of a top end of the inside and outside corners.

8. The crown molding as recited in claim 6, wherein each of the inside and outside corners includes a plurality of spaced spacers formed along a junction where a side of each of the inside and outside corners meets the tab; and further including a slot formed in each tab at the junction.

9. The crown molding as recited in claim 1, wherein the facing crown molding member includes upper and lower flange ends that are each secured thereto at a substantially right angle.

10. The crown molding as recited in claim 9, wherein, the first corrugations are on said upper flange end.

11. The crown molding as recited in claim 1, wherein the substantially flat top surface further comprises an inner portion spaced away from the ceiling.

12. The crown molding as recited in claim 1, further comprising a corner crown molding piece having third corrugations for engagement with the second corrugations in the "L" bracket section upper leg.

13. The crown molding as recited in claim 12, wherein the corner crown molding piece abuts the facing crown molding member.

14. The crown molding as recited in claim 12, wherein the corner crown molding piece comprises a tab extending out from a side of the corner crown molding piece, wherein the tab is configured to align with the facing crown molding member.

15. The crown molding as recited in claim 14, wherein the tab comprises an elongated slot.

16. The crown molding of claim 1, wherein the ridge portion is adjacent the first corrugations.

17. A molding section for a room ceiling, comprising:

a bracket attachable to a room adjacent a wall ceiling juncture comprising an upper leg and a lower leg joined at a corner, wherein a top surface of the upper leg comprises at least one first corrugation; and a crown molding piece comprising a facing member having a front surface and an upper flange that meet at a corner, wherein a lower surface of the upper flange comprises at least one second corrugation configured to engage the at least one first corrugation, the crown molding piece having a uniform cross-section, wherein the upper leg of the bracket is deflectable away from the room ceiling to receive the upper flange of the crown molding piece into the at least one first corrugation, such that the upper leg flexes back toward the room ceiling with the at least one first corrugation engaging the at least one second corrugation, wherein the upper flange comprises a ridge portion formed at the corner and extending past a top surface of the upper flange to contact the ceiling, the ridge portion being flush with the front surface of the facing member which is below the upper flange.

18. The molding section of claim 17, wherein the at least one first corrugation and the at least one second corrugation each comprise parallel, lateral corrugations.

19. The molding section of claim 17, further comprising a plurality of crown molding pieces aligned in abutting end to end contact.

20. The molding section of claim 17, wherein the bracket and the crown molding piece contact each other only at the at least one first and second corrugations.

21. The molding section of claim 17, wherein the ridge portion is adjacent the at least one second corrugation.

* * * * *